US010089912B2

(12) United States Patent
Tsai et al.

(10) Patent No.: US 10,089,912 B2
(45) Date of Patent: Oct. 2, 2018

(54) DISPLAY PANEL AND AUTOMATIC DETECTION METHOD THEREOF

(71) Applicant: INNOLUX CORPORATION, Miao-Li County (TW)

(72) Inventors: Yung-Yu Tsai, Miao-Li County (TW); Chia-Liang Lin, Miao-Li County (TW)

(73) Assignee: INNOLUX CORPORATION, Miao-Li County (TW)

( * ) Notice: Subject to any disclaimer, the term of this patent is extended or adjusted under 35 U.S.C. 154(b) by 0 days.

(21) Appl. No.: 14/875,253

(22) Filed: Oct. 5, 2015

(65) Prior Publication Data

US 2016/0104456 A1 Apr. 14, 2016

(30) Foreign Application Priority Data

Oct. 13, 2014 (TW) ..... 103135400 A

(51) Int. Cl.

| | |
|---|---|
| ***G09G 5/00*** | (2006.01) |
| ***G09G 3/20*** | (2006.01) |
| ***G09G 3/36*** | (2006.01) |
| ***G09G 3/00*** | (2006.01) |

(52) U.S. Cl.

CPC ..... *G09G 3/2003* (2013.01); *G09G 3/006* (2013.01); *G09G 3/2092* (2013.01); *G09G 3/3648* (2013.01)

(58) Field of Classification Search

CPC .... G09G 3/2003; G09G 3/006; G09G 3/2092; G09G 3/3648

USPC ..... 345/213

See application file for complete search history.

(56) References Cited

U.S. PATENT DOCUMENTS

2009/0303224 A1* 12/2009 Yoshida ..... G09G 3/3648 345/213
2011/0175800 A1* 7/2011 Mizumaki ..... G09G 3/006 345/87
2012/0075207 A1* 3/2012 Jang ..... G06F 3/044 345/173
2014/0035897 A1* 2/2014 Lee ..... G09G 3/3696 345/212
2014/0118372 A1* 5/2014 Hung ..... G09G 3/2096 345/532
2016/0148587 A1* 5/2016 Li ..... G09G 3/006 345/212

FOREIGN PATENT DOCUMENTS

CN 101800021 A 8/2010
TW 201423125 A 6/2014

OTHER PUBLICATIONS

Taiwan Patent Office, Office action dated May 26, 2016.
China Patent Office, Office action dated Aug. 30, 2017.

* cited by examiner

*Primary Examiner* — Nicholas Lee
*Assistant Examiner* — Ngan T Pham Lu
(74) *Attorney, Agent, or Firm* — Li & Cai Intellectual Property (USA) Office

(57) ABSTRACT

A display panel includes a first substrate, and at least one data driver integrated circuit. The data driver integrated circuit is electrically connected to the first substrate, wherein the data driver integrated circuit receives a first set signal and a second set signal, the first set signal includes a first data transmission interface, the second set signal includes a second data transmission interface, and the first data transmission interface and the second data transmission interface are different.

9 Claims, 7 Drawing Sheets

DISPLAY PANEL AND AUTOMATIC DETECTION METHOD THEREOF

BACKGROUND OF THE INVENTION

1. Field of the Invention

The instant disclosure relates to a display panel and detection method thereof; in particular, to a display panel and automatic detection method thereof including a data driver integrated circuit which has first and second data transmission interfaces simultaneously.

2. Description of Related Art

At present, a common liquid crystal display (LCD) and organic light emitting diode (OLED) includes an active element array substrate. The active element array substrate is such that, a thin film transistor is disposed on a substrate, a plurality of data lines and a plurality of scan lines are staggered with each other and electrically connected to the thin film transistor. A data driver integrated circuit can input a telecom signal which provides an imaging data into the panel through the data line.

Generally, a multi-channel inspection step in manufacturing process is necessary to find defective panels, wherein the image inspection is subjected to a lighting step, and the panel is lighted by inputting the telecom signal, timing signal, and video signal to the data driver integrated circuit so as to detect.

However, the lighting step needs to be conducted by connecting an external circuit board and inputting the telecom signal using a fixture for inputting the signal, and the external circuit board and fixture have to be repeatedly plugged in and out in the inspection step. Therefore, the lighting step is usually conducted by manual inspection, and it is harmful to the production line automation. Each display panel inspection is accompanied with a plug in and out, and this step is liable to damage the electrical transmission point of an external circuit board and fixture, so as to short circuit the inside of the display panel.

SUMMARY OF THE INVENTION

One of the embodiments of the instant disclosure provides a display panel which includes a first substrate, and at least one data driver integrated circuit. The data driver integrated circuit is electrically connected to the first substrate, wherein the data driver integrated circuit receives a first set signal and a second set signal, the first set signal includes a first data transmission interface, the second set signal includes a second data transmission interface, and the first data transmission interface and the second data transmission interface are different.

Another embodiment of the instant disclosure provides a display panel which includes a first substrate, at least one data driver integrated circuit, and a first circuit control board. The data driver integrated circuit is electrically connected to the first substrate. The first circuit control board is electrically connected to the data driver integrated circuit and receives a first set signal and a second set signal. The first set signal includes a first data transmission interface, the second set signal includes a second data transmission interface, and the first data transmission interface and the second data transmission interface are different.

One of the embodiments of the instant disclosure provides a detection method of display panel which includes a) providing a display panel, wherein the display panel includes: a first substrate, and at least one data driver integrated circuit. The data driver integrated circuit is electrically connected to the first substrate. The data driver integrated circuit receives a second set signal, and the second set signal includes a second data transmission interface. Then, b) inputting the second set signal to the data driver integrated circuit so that the display panel displays a test image.

Another embodiment of the instant disclosure provides a detection method of display panel which includes a) providing a display panel, wherein the display panel includes a first substrate, at least one data driver integrated circuit, and a first circuit control board. Wherein the data driver integrated circuit is electrically connected to the first substrate and the first circuit control board, the first circuit control board receives a second set signal, and the second set signal includes a second data transmission interface. Then, b) inputting the second set signal to the first circuit control board so that the display panel displays a test image.

In summary, the display panel of the embodiments of the instant disclosure includes the data driver integrated circuit which can receive the first and second data transmission interfaces, the data driver integrated circuit can respectively transmit the first and second set signals to the display panel through the different transmission interfaces, such that the display panel can show a user viewing image or the test image respectively depending upon the first and second set signals. In practice, the data driver integrated circuit includes a first interface unit and a second interface unit, the first interface unit and the second interface unit respectively receive the first data transmission interface and the second data transmission interface.

Additionally, the display panel further includes the first circuit control board which includes a third interface unit and a fourth interface unit. The third interface unit corresponds to the first interface unit, and they are both used for receiving the first set signal including the first data transmission interface. The fourth interface unit corresponds to the second interface unit, and they are both used for receiving the second set signal including the second data transmission interface. In practice, examples of structures of the third and fourth interface units of the first circuit control board include, but are not limited to at least one via, metal pad, probe point, and combinations thereof Through these structures, the second set signal can be directly and quickly transmitted to the data driver integrated circuit and further transmitted into the display panel by plugging or contacting, and the display panel displays a test image, so as to simplify the lighting step. In addition, an example of the third and fourth interface units includes, but is not limited to a pluggable electrical connector structure. Practically, the third interface unit can be a slot for the signal being inputted, and the fourth interface unit can be the structure such as a metal pad or a probe point. When the display panel is in a normal display state, the first set signal is transmitted into the display panel through the third interface unit via a regular slot interface. When the display panel is subjected to the lighting step, the second set signal can be directly and quickly transmitted into the display panel through the fourth interface unit via the metal pad interface or probe point interface, so as to simplify the lighting step.

The detection method of display panel provided from the embodiments of the instant disclosure can simplify, speed up, and automatize the lighting step, the third and fourth interface units can be the interface structure such as the metal pad, via, or probe point, and the second set signal can be directly and quickly transmitted into the panel by plugging or contacting, so that the display panel displays a test image. The circuit control board of the prior art only includes one interface unit and receives the first data transmission interface, hence the second set signal including the second data transmission interface requires an external flexible circuit board and a fixture for signal input to be transmitted to the circuit control board of prior art. Compared to the prior art, since there is the circuit control board including the first and second data transmission interfaces in the instant disclosure, the telecom signal being inputted by the external flexible circuit board and the fixture for signal input can be omitted in the lighting step, so as to further simplify the procedure of and speed up the lighting step of the display panel.

In order to further appreciate the characteristics and technical contents of the instant disclosure, references are hereunder made to the detailed descriptions and appended drawings in connection with the instant disclosure. However, the appended drawings are merely shown for exemplary purposes, rather than being used to restrict the scope of the instant disclosure.

DETAILED DESCRIPTION OF THE PREFERRED EMBODIMENTS

Embodiments disclosed in the instant disclosure are illustrated via specific examples as follows, and people familiar in the art may easily understand the advantages and efficacies of the instant disclosure by disclosure of the specification. The instant disclosure may be implemented or applied by other different specific examples, and each of the details in the specification may be applied based on different views and may be modified and changed under the existence of the spirit of the instant disclosure. The figures in the instant disclosure are only for brief description, but they are not depicted according to actual size and do not reflect the actual size of the relevant structure. The following embodiments further illustrate related technologies of the instant disclosure in detail, but the scope of the instant disclosure is not limited herein.

Figure 1:
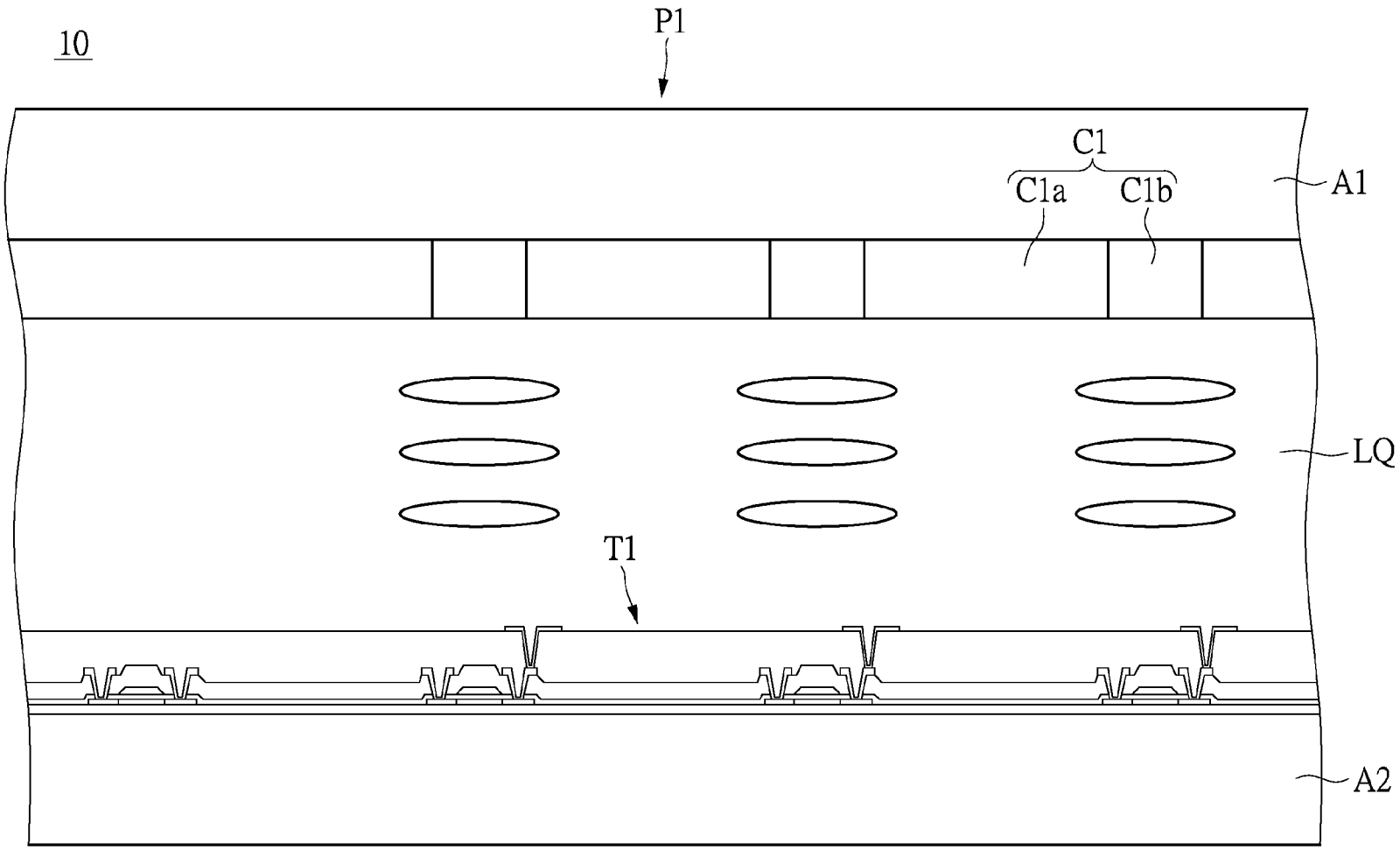
FIG. 1 shows a cross-sectional schematic view of a display panel of a first embodiment in the instant disclosure.

FIG. 1 shows a cross-sectional schematic view of a liquid crystal display panel of a first embodiment in the instant disclosure. Please refer to FIG. 1. The display panel 10 includes a first substrate A1, a second substrate A2, a liquid crystal layer LQ, a color filter layer C1, and an active element array layer T1. The first substrate A1 and the second substrate A2 are combined through a sealing material, and the liquid crystal layer LQ is sealed therein. The color filter layer C1 is disposed on the first substrate A1, and the active element array layer T1 is disposed on the second substrate A2. The display panel 10 can be utilized in a display device such as a TV, laptop, or mobile phone, wherein an image displayed by the display panel 10 is presented in the P1 position of the panel. In other embodiment, the display panel could be an organic light emitting diode (OLED) comprises one substrate and without liquid crystal layer LQ, but having organic light emitting diode elements for lighting actively.

Examples of a material of the first substrate A1 and the second substrate A2 include, but are not limited to glass, plastic, and quartz, and combinations thereof.

The display panel 10 can include the color filter layer C1 disposed on the first substrate A1, wherein the color filter layer C1 includes a color filter C1*a* and light-shielding layer C1*b* having a variety of colors. The light-shielding layer C1*b* is mainly used to cover light from a backlight module to prevent affecting the image performance due to leakage of incident light. Examples of a material of the light-shielding layer C1*b* include, but are not limited to a black resin, black photoresist material, and combinations thereof The color filter C1*a* can be a colored photoresist, the material of the color filter C1*a* can be a color photoresist material, and the color can be red, green, blue, or transparent.

The liquid crystal layer LQ is disposed between the first substrate A1 and the second substrate A2 having a space to adjust a direction of incident light. Examples of a material of the liquid crystal layer LQ include, but are not limited to nematic liquid crystal, smectic liquid crystal, cholesteric liquid crystal, and combinations thereof.

The active element array layer T1 is disposed on the second substrate A2, and the active element array layer T1 includes a plurality of thin film transistors, a plurality of data lines (not shown), and a plurality of scan lines (not shown), the mutually parallel data lines and the mutually parallel scan lines are staggered with each other, and the thin film transistors are formed between the data lines and the scan lines having a junction. An active element array composed of the thin film transistors corresponds to an arrangement formed by the above color filter C1*a*. It is worth mentioning that each of the thin film transistors includes a gate electrode, a gate insulating layer, a source electrode, and a drain electrode formed on the second substrate A2, wherein the source electrode is coupled and connected to the data lines, and the gate electrode is coupled and connected to the scan lines.

Figure 2:
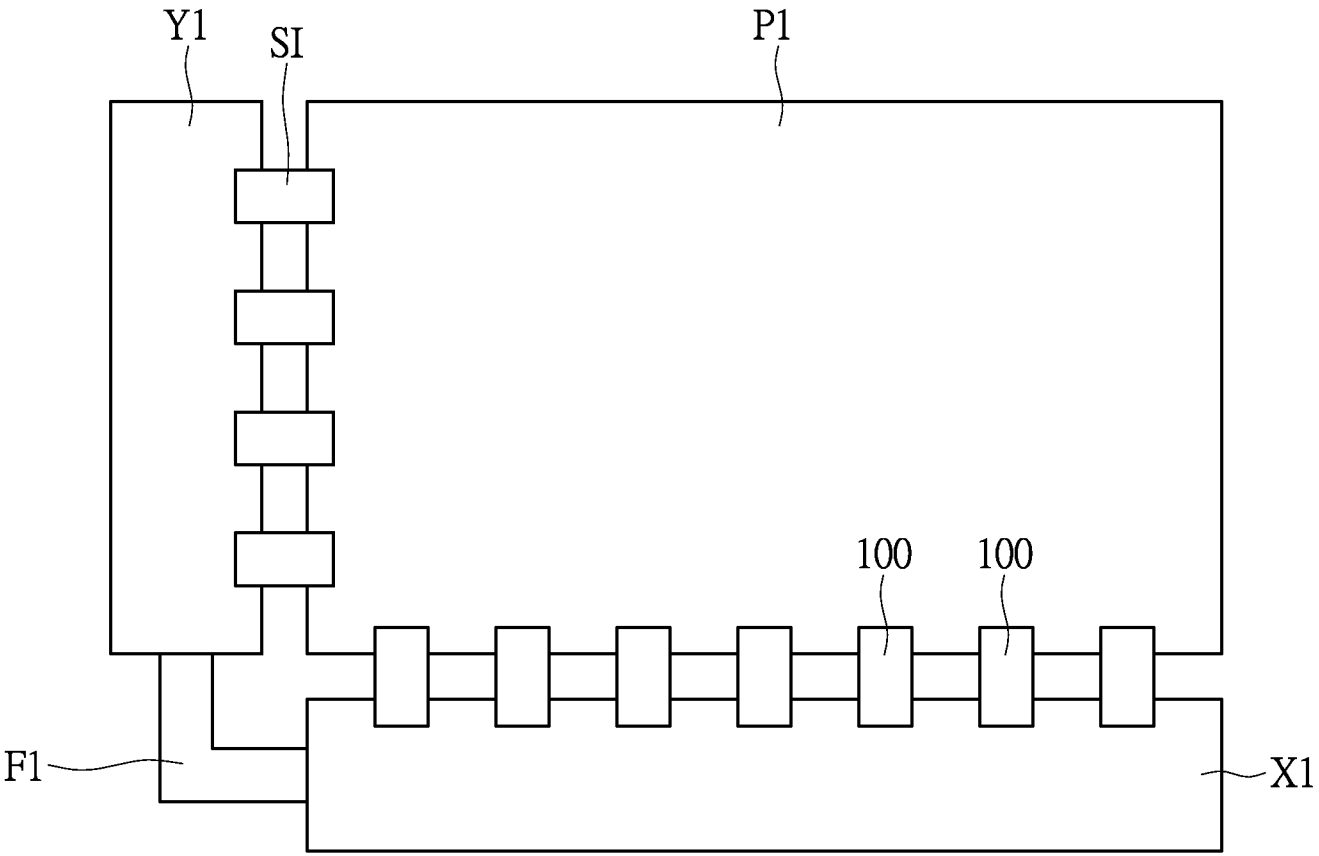
FIG. 2 shows a schematic plan view of a display panel of a first embodiment in the instant disclosure.

FIG. 2 shows a schematic plan view of a display panel of a first embodiment in the instant disclosure. Please refer to FIG. 2. In this embodiment, the display panel 10 includes a first circuit control board X1 and a second circuit control board Y1, the first circuit control board X1 is disposed at one side of the display panel 10, the second circuit control board Y1 is disposed at another side of the display panel 10 close to the first circuit control board X1, and the first circuit control board X1 and the second circuit control board Y1 are respectively used as integrated boards of the display panel 10 for transmitting various signals. Practically, the first circuit control board X1 and the second circuit control board Y1 can be printed circuit boards or flexible circuit boards, and the first circuit control board X1 and the second circuit control board Y1 are electrically connected to each other via a flexible circuit board F1. However, in other embodiments, in order to take into consideration a variety of design processes of display panels and electrical assembly requirements, the display panel 10 could only include the first circuit control board X1 and not include the second circuit control board Y1, and the signal is transmitted by the first circuit control board X1, but it is not limited in this instant disclosure.

A data driver unit is electrically connected to the first circuit control board X1, and a scan driver unit is electrically connected to the second circuit control board Y1. The data driver unit includes a plurality of data driver integrated circuits 100, and the scan driver unit includes a plurality of scan driver integrated circuits S1. Each of the data driver integrated circuits 100 is used for inputting an imaging data, and can receive the signal transmitted from the first circuit control board X1 and transmit the signal into the panel P1 through the data line. The scan driver integrated circuit S1 is used for controlling a switch of the transistor, and can receive the signal transmitted from the first circuit control board X1 through the second circuit control board Y1 and transmit the signal into the panel P1 through the scan line. However, in other embodiments, the display panel could only include the first circuit control board X1 and not include the second circuit control board Y1, and both the data driver integrated circuit 100 and the scan driver integrated circuit S1 can transmit the signal by the first circuit control board X1, but it is not limited in this instant disclosure.

Figure 3:
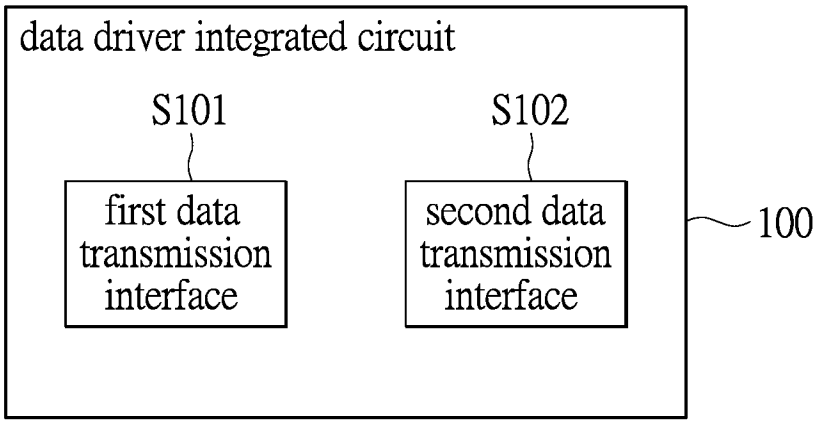
FIG. 3 shows a function block diagram of a data driver integrated circuit of a display panel of a first embodiment in the instant disclosure.

FIG. 3 shows a function block diagram of a data driver integrated circuit of a display panel of a first embodiment in the instant disclosure. Please refer to FIG. 3. The data driver integrated circuit 100 receives a first set signal S1 and a second set signal S2, the first set signal S1 includes a first data transmission interface S101, and the second set signal S2 includes a second data transmission interface S102, wherein both of the first data transmission interface S101 and the second data transmission interface S102 are used to define an interface transmission in a panel display system. For example, the first data transmission interface S101 can be an interface specification signal of mini low voltage differential signal interface (mini-LVDS), and the second data transmission interface S102 can be an interface specification signal of a reduced swing differential signal interface (RSDS).

Specifically, the first set signal S1 further includes a power signal, a scan timing signal, and a data timing signal, and the display panel 10 can receive the first set signal S1 through the data driver integrated circuits 100 to display a first display image. It is worth to mention that, the first display image is defined so that when a user is viewing, the first display image can provide a normal display image for the user. In this embodiment, the second set signal S2 could only include the data transmission interface, or further include the power signal, the scan timing signal, and the data timing signal, and the display panel 10 can receive the second set signal S2 through the data driver integrated circuits 100 to display a second display image. It is worth to note that the second display image is defined so that when a lighting step is conducted, the display panel 10 displays a mono image through the second set signal S2 provided from a pattern generator. For example, a plain white, plain black, plain red, plain blue, or plain green image. That is, the second display image can be a test image for the lighting step, and the display panel 10 is inspected to see if a defective display image exists therein in accordance with the test image. Hence, the test image is not the same as the image for user viewing.

In addition, in order to simplify the lighting step, the power signal, the scan timing signal, and the data timing signal of the second set signal S2 can be substantially the same as the power signal, the scan timing signal, and the data timing signal of the first set signal S1.

In practice, the data driver integrated circuit 100 includes a first interface unit 110 and a second interface unit 120. Both the first interface unit 110 and the second interface unit 120 are used to provide an interface for the display panel 10 to control the signals, and the first interface unit 110 and the second interface unit 120 receive the first data transmission interface S101 and the second data transmission interface S102 respectively. Accordingly, the first set signal S1 can be transmitted to the data driver integrated circuit 100 via the first interface unit 110 of the data driver integrated circuit 100, such that the display panel 10 can display the first display image, that is, the display panel 10 provides the normal display image for the user. Furthermore, the first data transmission interface S101 and the second data transmission interface S102 can be transmitted to the data driver integrated circuit 100 via different electrical transmission points. However, in consideration of different layout designs, the first data transmission interface S101 and the second data transmission interface S102 also can be transmitted to the data driver integrated circuit 100 via the same electrical transmission point, that is, for example if a metal pad is co-used.

In addition, since a difference of the second set signal S2 and the first set signal S1 is that the second set signal S2 including the second data transmission interface S102 is not equal to the first set signal S1 including the first data transmission interface S101, thus, the second set signal S2 can be transmitted to the data driver integrated circuit 100 via the second interface unit 120 of the data driver integrated circuit 100, such that the display panel 10 can display the second display image, that is, the display panel 10 provides the test image for the lighting step.

Since the data driver integrated circuit 100 can receive the first data transmission interface S101 and the second data transmission interface S102, via the different transmission interfaces, the data driver integrated circuit 100 can respectively transmit the first set signal S1 and the second set signal S2 into the display panel 10, such that the display panel 10 can display the user viewing image or the test image respectively depending on the first set signal S1 and the second set signal S2.

Figure 4:
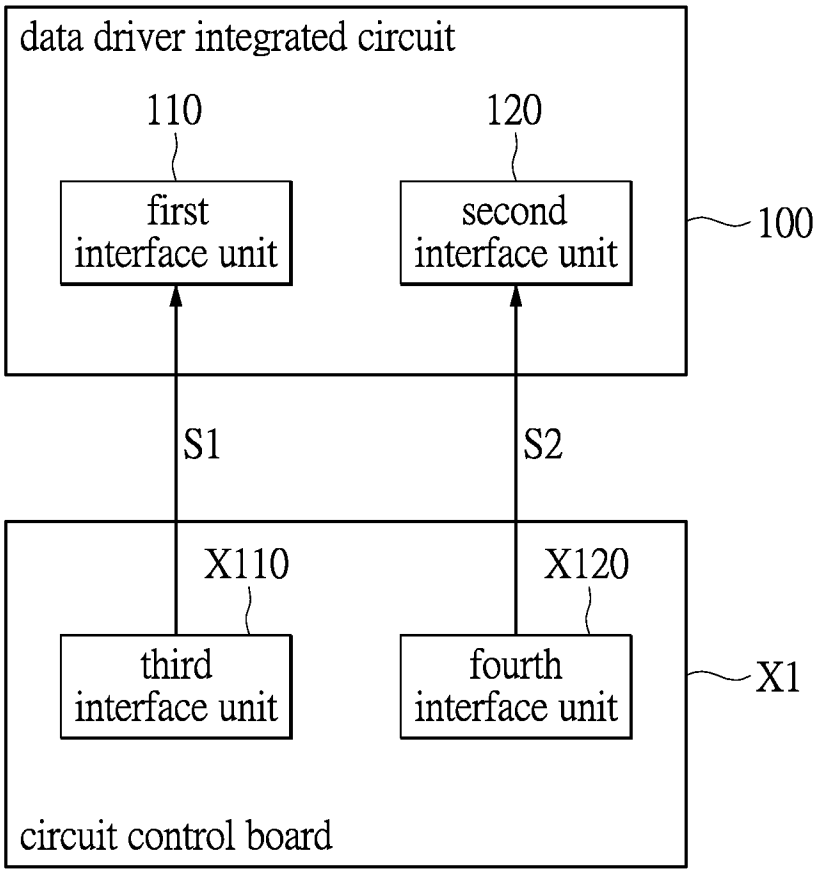
FIG. 4 shows a function block diagram of a data driver integrated circuit and a circuit control board of a display panel of a first embodiment in the instant disclosure.

FIG. 4 shows a function block diagram of a data driver integrated circuit and a circuit control board of a display panel of a first embodiment in the instant disclosure. Based on the abovementioned display panel 10, the instant disclosure provides a circuit control board which is applied in the display panel 10, for more detailed embodiments of the data driver integrated circuit 100 of the display panel 10 refer to the abovementioned descriptions, as the identical information is not repeated herein.

Please refer to FIG. 4. Both of the first interface unit 110 and the second interface unit 120 of the data driver integrated circuit 100 are used to provide the interface for the display panel 10 controlling the signals. The first circuit control board X1 of the display panel 10 includes a third interface unit X110 and a fourth interface unit X120, the third interface unit X110 is electrically connected to the first interface unit 110, and the fourth interface unit X120 is electrically connected to the second interface unit 120. It is worth mentioning that the third interface unit X110 corresponds to the first interface unit 110, and they are both used for receiving the first set signal S1 including the first data transmission interface S101. The fourth interface unit X120 corresponds to the second interface unit 120, and they are both used for receiving the second set signal S2 including the second data transmission interface S102.

Specifically, since the data driver integrated circuit 100 is electrically connected to the first circuit control board X1, the first set signal S1 can be transmitted to the first interface unit 110 of the data driver integrated circuit 100 via the third interface unit X110 disposed on the first circuit control board X1, and the display panel 10 can receive the first set signal S1 through the first interface unit 110 so as to display the first display image. In this embodiment, the second set signal S2 can be transmitted to the second interface unit 120 via the fourth interface unit X120 disposed on the first circuit control board X1, and the display panel 10 can receive the second set signal S2 through the second interface unit 120 so as to display the second display image.

Further, when the display panel 10 is in a normal display state, that is, when the user is viewing the image, the data driver integrated circuit 100 transmits the first set signal S1 into the panel P1 through the electrically connected third interface unit X110 and first interface unit 110, so that the display panel 10 displays the first display image. When the lighting step is conducted, the data driver integrated circuit 100 transmits the second set signal S2 into the panel P1 through the electrically connected fourth interface unit X120 and second interface unit 120, so that the display panel 10 displays the second display image.

In practice, in order to transmit the first set signal S1 and the second set signal S2 into the display panel 10 through the first interface unit 110 and the second interface unit 120 respectively, the layout design of the electrically connected third and first interface units X110, 110 and the layout design of the electrically connected fourth and second interface units X120, 120 are different. That is, the first set signal S1 and the second set signal S2 use different circuit traces.

Practically, the third interface unit X110 and the fourth interface unit X120 of the first circuit control board X1 can be a structure such as a metal pad, a via, or a probe point. Through these structures, the second set signal S2 can be directly and quickly transmitted to the data driver integrated circuit 100 and further transmitted into the display panel 10 by plugging or contacting, and the display panel 10 then displays a test image, so as to simplify the lighting step. In addition, the structure of the fourth interface unit X120 also can be a pluggable electrical connector structure.

It is worth noting that the second interface unit 120 can include a plurality of electrical transmission points for transmitting the second set signal S2. In order to inspect whether the functions of power, timing, and image of the display panel 10 are able to work normally, the display panel 10 can transmit the second set signal S2 to the second interface unit 120 to conduct the lighting step. In the layout design, the second interface unit 120 can include the plurality of electrical transmission points for transmitting the power signal, the scan timing signal, the data timing signal, and the second data transmission interface S102 of the second set signal S2.

However, during the lighting step of the display panel 10, if only an image signal is inputted to inspect the image display function, the second set signal S2 can only include the image signal and the second data transmission interface S102, such that the electrical transmission point for transmitting the power signal, the scan timing signal, and the data timing signal can be disposed at the first interface unit 110, and the electrical transmission point for transmitting the image signal and the second data transmission interface S102 can be disposed at the second interface unit 120.

Figure 5:
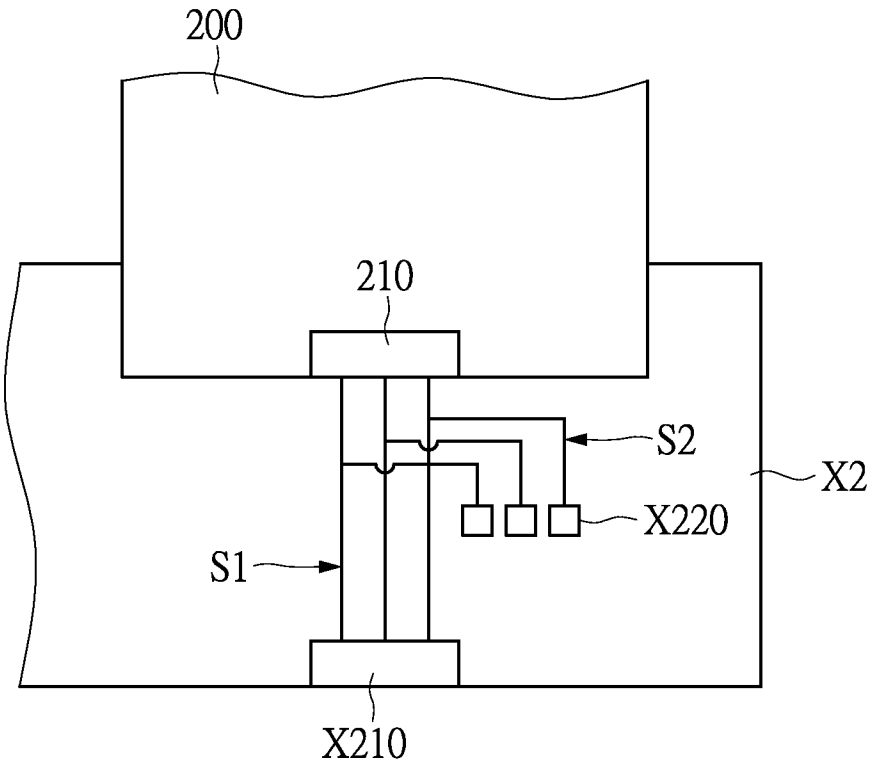
FIG. 5 shows a function block diagram of a data driver integrated circuit and a circuit control board of a display panel of a second embodiment in the instant disclosure.

FIG. 5 shows a function block diagram of a data driver integrated circuit and a circuit control board of a display panel of a second embodiment in the instant disclosure. Based on the abovementioned display panel 10, the instant disclosure provides another data driver integrated circuit which is applied in the display panel 10, for more detailed embodiments refer to the abovementioned descriptions, and the identical information is not repeated herein.

Please refer to FIG. 5. The data driver integrated circuit 200 includes a first interface unit 210, the first circuit control board X2 includes a third interface unit X210 and a fourth interface unit X220, and both of the third and fourth interface units X210, X220 are electrically connected to the first interface unit 210. In this embodiment, the data driver integrated circuit 200 includes a first interface unit 210, that is, an interface of the data driver integrated circuit 200 for receiving the first and second data transmission interface S101, S102 can be shared. In another embodiment, the interface of the data driver integrated circuit 200 for receiving the first and second data transmission interface S101, S102 cannot be shared, that is, the data driver integrated circuit 200 includes the first interface unit 210 and the second interface unit, the third interface unit X210 is electrically connected to the first interface unit 210, and the fourth interface unit X220 is electrically connected to the first interface unit 210.

Specifically, the first interface unit 210 can receive the first set signal S1 and the second set signal S2, that is, the first interface unit 210 is compatible with the first data transmission interface S101 and the second data transmission interface S102. The first set signal S1 also includes the power signal, the scan timing signal, the data timing signal, and the first data transmission interface S101. The first set signal S1 can be transmitted to the first interface unit 210 via the third interface unit X210, and the data driver integrated circuit 200 determines whether the received signal is the first set signal S1, such that the display panel 10 can display the normal display image. The second set signal S2 can be transmitted to the first interface unit 210 via the fourth interface unit X220, the data driver integrated circuit 200 determines whether the received signal is the second set signal S2, and the display panel 10 can receive the second set signal S2 through the first interface unit 210, so as to display the test image.

In the layout design, the first set signal S1 is transmitted to the data driver integrated circuit 200 through at least one of the wire lines of the electrically connected first and third interface units 210, X210. The second set signal S2 is transmitted to the data driver integrated circuit 200 through at least one of the wire lines of the electrically connected first and fourth interface units 210, X220. The fourth interface unit X220 can be the metal pad or the via disposed on the first circuit control board X1, and the layout design of the electrically connected first and third interface units 210, X210 and the layout design of the electrically connected first and fourth interface units 210, X220 are different. The first set signal S1 and the second set signal S2 are transmitted to the first interface units 210 respectively.

Figure 6:
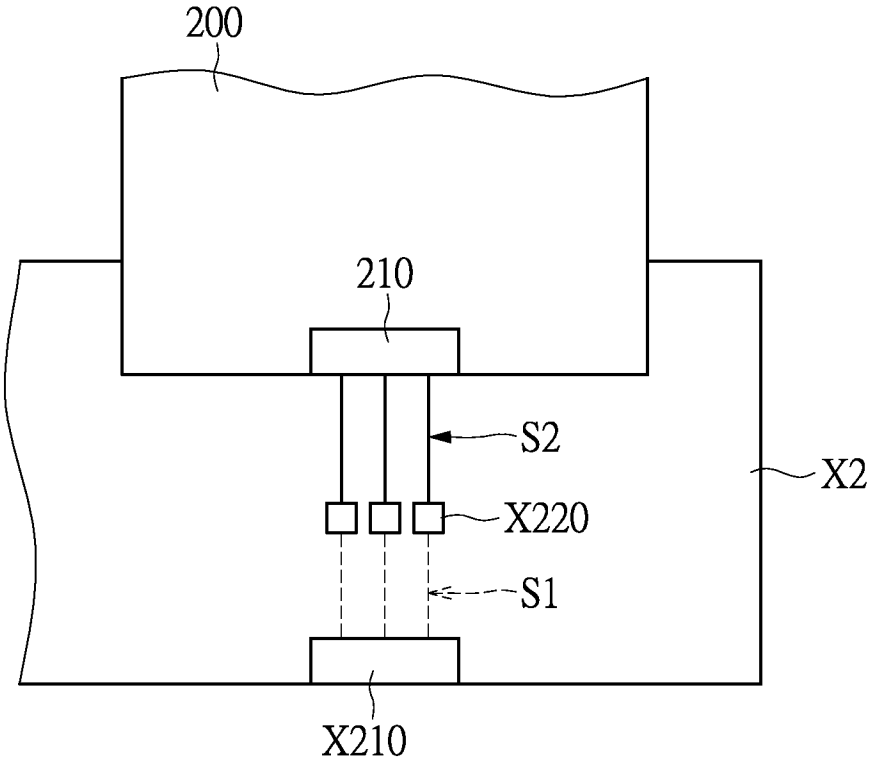
FIG. 6 shows a schematic view of a data driver integrated circuit and a circuit control board of a display panel of a second embodiment in the instant disclosure.

FIG. 6 shows a schematic view of a data driver integrated circuit and a circuit control board of a display panel of a second embodiment in the instant disclosure. Please refer to FIG. 6. Since both the first set signal S1 and the second set signal S2 are transmitted to the first interface unit 210, thus, in order to simplify the layout design, the fourth interface unit X220 can be the metal pad or the via disposed on the wire line which is from the third interface unit X210 to first interface unit 210. In detail, the layout design of the electrically connected first and fourth interface units 210, X220 is a part of the layout design of the electrically connected first and third interface units 210, X210. Accordingly, the first set signal S1 and the second set signal S2 can be transmitted to the data driver integrated circuit 200 by sharing a part of a wire line.

Figure 7:
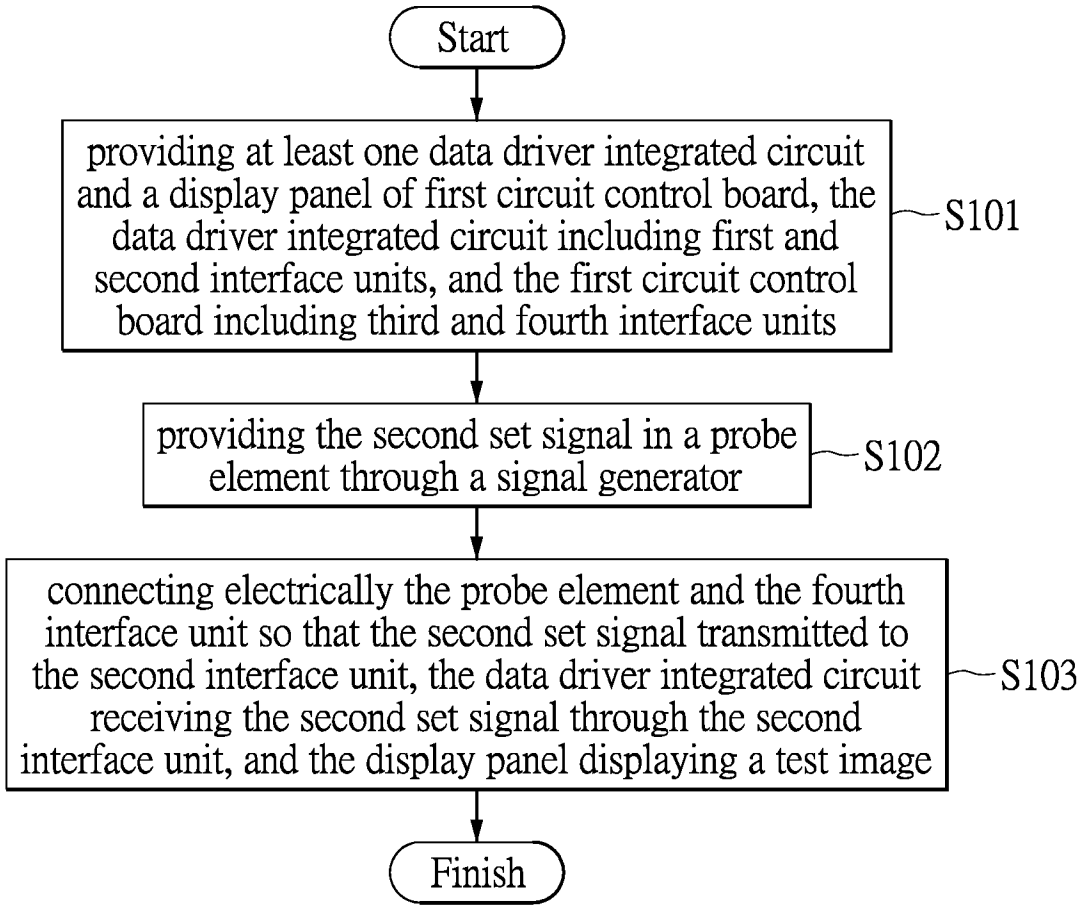
FIG. 7 shows a flow chart of an automatic detection method of the display panel of a first embodiment in the instant disclosure.

FIG. 7 shows a flow chart of an automatic detection method of the display panel of a first embodiment in the instant disclosure. Please refer to FIG. 7.

Conducting step S101, providing a display panel 10 (test object). The display panel 10 includes at least one data driver integrated circuit 100, and a first circuit control board X1 electrically connected to the data driver integrated circuit 100. The first circuit control board X1 can receive the first set signal S1 and the second set signal S2, the first set signal S1 includes the first data transmission interface S101, and the second set signal S2 includes the second data transmission interface S102. The first data transmission interface S101 is not equal to the second data transmission interface S102.

Conducting step S102, when the display panel 10 is subjected to the lighting step to inspect the functions of power, timing, and image of the display panel 10, a tester provides the second set signal S2 in a probe element through a signal generator, and the second set signal S2 includes the power signal, the scan timing signal, the data timing signal, and the second data transmission interface. However, the second set signal S2 can only include the second data transmission interface.

Conducting step S103, the probe element is electrically connected to the fourth interface unit X220. Practically, the fourth interface unit X220 can be an interface structure e.g., a metal pad, a via, or a probe point, so that the second set signal S2 can be directly and quickly transmitted to the fourth interface unit X220 by plugging or contacting. Since the fourth interface unit X220 is electrically connected to the second interface unit 120, the second set signal S2 is transmitted to the second interface unit 120, and the data driver integrated circuit 100 receives the second set signal S2 through the second interface unit 120, such that the display panel 10 displays the test image.

In summary, the embodiment of the instant disclosure provides a display panel which includes a data driver integrated circuit, and the data driver integrated circuit can receive the first data transmission interface and the second data transmission interface. Hence, the data driver integrated circuit can respectively transmit the first and second set signals to the display panel through the different transmission interfaces, such that the display panel can show the user viewing image or the test image respectively depending upon the first and second set signals. In practice, the data driver integrated circuit includes the first interface unit and the second interface unit, the first interface unit and the second interface unit respectively receive the first data transmission interface and the second data transmission interface. The circuit control board includes the third interface unit and the fourth interface unit, the third interface unit and the fourth interface unit respectively receive the first data transmission interface and the second data transmission interface. Practically, the third interface unit can be a slot for the signal being inputted, and the fourth interface unit can be a structure such as the metal pad or the probe point. When the display panel is in a normal display state, the first set signal is transmitted into the display panel through a regular slot interface. When the display panel is subjected to the lighting step, the second set signal can be directly and quickly transmitted into the display panel via an interface such as the metal pad interface or the probe point interface, so as to simplify the lighting step.

The automatic detection method of a display panel provided from the embodiment of the instant disclosure can simplify, speed up, and automatize the lighting step, the fourth interface unit can be an interface structure such as the metal pad, via, or probe point, and the second set signal can be directly and quickly transmitted into the panel by plugging or contacting, so that the display panel displays the test image. The circuit control board of prior art only includes one interface unit and receives the first data transmission interface, hence the second set signal including the second data transmission interface requires an external flexible circuit board and a fixture for signal input to be transmitted to the circuit control board. Compared to the prior art, since the circuit control board includes the third and fourth interface units in the instant disclosure, the telecom signal being inputted by the external flexible circuit board and the fixture for signal input can be omitted in the lighting step, so as to further simplify the procedure and speed up the lighting step of the display panel.

The descriptions illustrated supra set forth simply the preferred embodiments of the instant disclosure; however, the characteristics of the instant disclosure are by no means restricted thereto. All changes, alterations, or modifications conveniently considered by those skilled in the art are deemed to be encompassed within the scope of the instant disclosure delineated by the following claims.

What is claimed is:

1. A display panel, comprising:

a first substrate; and at least one data driver integrated circuit electrically connected to the first substrate;

wherein the data driver integrated circuit receives a first set signal and a second set signal, the first set signal includes a first data transmission interface, the second set signal includes a second data transmission interface, and the first data transmission interface and the second data transmission interface are different;

wherein the data driver integrated circuit includes a first interface unit and a second interface unit, and the first interface unit and the second interface unit receive the first set signal and the second set signal, respectively;

wherein the first data transmission interface is an interface specification signal of a mini low voltage differential signal interface, and the second data transmission interface is an interface specification signal of a reduced swing differential signal interface; and wherein when the data driver integrated circuit receives the first set signal via the first interface unit, the display panel displays a normal image, and when the data driver integrated circuit receives the second set signal via the second interface unit, the display panel displays a test image.

2. The display panel as claimed in claim 1, wherein the second set signal further comprises a power signal, a scan timing signal, and a data timing signal.

3. The display panel as claimed in claim 1, wherein the first data transmission interface and the second data transmission interface are transmitted to the data driver integrated circuit via the same electrical transmission point.

4. A display panel, comprising:

a first substrate;

at least one data driver integrated circuit electrically connected to the first substrate; and a first circuit control board electrically connected to the data driver integrated circuit and receiving a first set signal and a second set signal, the first set signal including a first data transmission interface, the second set signal including a second data transmission interface, and the first data transmission interface and the second data transmission interface are different;

wherein the least one data driver integrated circuit includes a first interface unit and a second interface unit, and the first interface unit and the second interface unit receive the first set signal and the second set signal, respectively;

wherein the first data transmission interface is an interface specification signal of a mini low voltage differential signal interface, and the second data transmission interface is an interface specification signal of a reduced swing differential signal interface; and wherein when the at least one data driver integrated circuit receives the first set signal via the first interface unit, the display panel displays a normal image, and when the data driver integrated circuit receives the second set signal via the second interface unit, the display panel displays a test image.

5. The display panel as claimed in claim 4, wherein the data driver integrated circuit includes a first interface unit, the first circuit control board includes a third interface unit and a fourth interface unit, the first set signal is transmitted to the data driver integrated circuit via being electrically connected to at least one wire line of the first interface unit and the third interface unit, and the second set signal is transmitted to the data driver integrated circuit via being electrically connected to at least one wire line of the first interface unit and the fourth interface unit.

6. The display panel as claimed in claim 5, wherein the wire line electrically connected to the first interface unit and the fourth interface unit is a part of the wire line electrically connected to the first interface unit and the third interface unit.

7. A method, comprising:

providing a display panel, wherein the display panel comprises: a first substrate, at least one data driver integrated circuit, and a first circuit control board, wherein the data driver integrated circuit is electrically connected to the first substrate and the first circuit control board, the first circuit control board receives a first set signal, and the first set signal includes a first data transmission interface standard; and inputting the first set signal to the first circuit control board so that the display panel displays a test image;

wherein the least one data driver integrated circuit includes a first interface unit and a second interface unit, and the first interface unit and the second interface unit receive the first set signal and the second set signal, respectively;

wherein the first data transmission interface is an interface specification signal of a mini low voltage differential signal interface; and wherein when the at least one data driver integrated circuit receives the first set signal via the first interface unit, the display panel displays a normal image, and when the data driver integrated circuit receives the second set signal via the second interface unit, the display panel displays a test image.

8. The method as claimed in claim 7, wherein steps of inputting the first set signal to the first circuit control board comprise:

providing the first set signal in a probe element through a signal generator; and connecting a probe element and a second interface unit on the first circuit control board so that the first set signal is transmitted to the first circuit control board, and the data driver integrated circuit receiving the first set signal through the first circuit control board.

9. The method as claimed in claim 8, wherein the second interface unit is comprised from a group consisting of at least one via, at least one metal pad, and combinations thereof.

* * * * *